US005293883A

United States Patent [19]

Edwards

[11] Patent Number: 5,293,883

[45] Date of Patent: Mar. 15, 1994

[54] NON-COMBUSTIBLE ANTI-SMOKING DEVICE WITH NICOTINE IMPREGNATED MOUTHPIECE

[76] Inventor: Patrica T. Edwards, P.O. Box 61194, San Angelo, Tex. 76906

[21] Appl. No.: 877,971

[22] Filed: May 4, 1992

[51] Int. Cl.[5] ..... A24F 47/00; A63D 3/00

[52] U.S. Cl. ..... 131/270; 131/336

[58] Field of Search ..... 131/270, 336

[56] References Cited

U.S. PATENT DOCUMENTS 3,258,015 6/1966 Ellis et al. .
3,334,636 8/1967 Zuber .
3,349,776 10/1967 Bell ..... 131/336
3,356,094 12/1967 Ellis et al. .
3,390,686 7/1968 Irby, Jr, et al. .
4,813,437 3/1989 Ray .
4,917,120 4/1990 Hill .
4,917,128 4/1990 Clearman et al. .
4,938,236 7/1990 Banerjee et al. .
4,995,407 2/1991 Kossiakoff et al. .

*Primary Examiner*—Vincent Millin
*Assistant Examiner*—William M. Pierce
*Attorney, Agent, or Firm*—Harold E. Meier

[57] ABSTRACT

The invention includes a non-pyrolytic cigarette, having an elongated tube of approximately the same, shape, dimensions, and weight of a traditional cigarette. The elongated tube contains two tobacco-filled chambers along its length and incorporates a filter at the end placed in the mouth of the user. The chambers contain pre-burned tobacco and unburned tobacco. A central air passageway communicates with the tobacco-containing chambers, and provides the taste, smell and sensation of a traditional cigarette as air is drawn through the tube and is delivered to the user. Additionally, a multiplicity of nicotine-containing ampules located within the mouth filter release liquid nicotine into the mouth of the user when pressure is applied to the filter.

15 Claims, 2 Drawing Sheets

NON-COMBUSTIBLE ANTI-SMOKING DEVICE WITH NICOTINE IMPREGNATED MOUTHPIECE

TECHNICAL FIELD

This invention relates to smoking devices and, more particularly, to a smokeless cigarette which provides the look, feel and taste of a traditional cigarette without the ignition and combustion of tobacco.

BACKGROUND AND SUMMARY

The most popular use of nicotine, an addictive, relatively harmless agent produced from the combustion of tobacco, involves the smoking of cigarettes or cigars. Individuals inhale the smoke from these devices in an effort to obtain the pleasant physiological effect that nicotine has on the body. Nicotine is absorbed by the lungs when the smoker inhales the smoke. Unfortunately, nicotine is only one of over four thousand components of cigarette smoke, four hundred of which are known carcinogens or harmful toxins. It is now widely known that these other elements of cigarette smoke are responsible for a number of serious physical ailments, including lung cancer. Additionally, recent studies indicate that even second-hand smoke (i.e., smoke inhaled while in close proximity to a smoker) can cause these same maladies in non-smokers.

Furthermore, a substantial number of fires are caused as a result of smoking. Thousands of people are injured or killed, and millions of dollars in property loss occur each year in the United States as a direct result of cigarette smoking. Finally, a few relatively minor problems associated with smoking—stained teeth, dry and wrinkle-prone skin, and smoke-damaged clothing—make the habit annoying as well as dangerous.

In response to these concerns, businesses, employers, and law makers have restricted or prohibited the use of cigarettes in a variety of places and situations. For example, in the United States virtually all domestic airline flight prohibit smoking. And while most restaurants provide both smoking and non-smoking sections, many offices, hospitals, campuses and even whole cities have banned the activity altogether.

A variety of cigarette-like devices have been invented in an effort to counteract the foregoing negative aspects of smoking. These devices, however, have only provided limited solutions often at the expense of commercial success or consumer acceptance since they lack the normal look, feel, and sensation of smoking a traditional cigarette. Complex filters and devices which otherwise improve the quality of the smoke delivered to the smoker do not provide solutions to the bulk of the concerns associated with traditional cigarettes. These devices are still ignited and still produce the same health, safety and practical concerns associated with smoking traditional cigarettes. Non-ignited devices, while eliminating the concerns associated with smoke, do not offer the user the look, feel and sensation of actually smoking a traditional cigarette. Furthermore, many of these devices do not provide the user with nicotine. Finally, a large number of the existing devices involve complicated designs, resulting in higher costs for manufacturers and consumers alike.

The present invention provides a solution to the aforementioned shortcomings of available alternatives to traditional cigarette smoking. The invention is a non-ignited device, having approximately the same shape, dimensions, and weight of a traditional cigarette. The device contains two chambers along its length and incorporates a filter at the end of the smoking device placed in the mouth. The chambers contain pre-burned tobacco and unburned tobacco. The device is placed in the mouth of the user but is not lit. As the user draws on the tube, air is drawn through the center of the device. As the air moves through the device, it is flavored by the tobacco-containing chambers, which provides the taste, smell and sensation of a traditional cigarette. Additionally, ampules located within the mouth filter of the device release liquid nicotine into the mouth of the user when the user applies pressure to the mouth filter. The user can manually crush the ampules in the mouth filter before it is placed in the mouth, or bite down on the mouth filter as the device is used.

Thus the user simultaneously receives the tobacco-flavored air and the nicotine without being exposed to the carcinogens and other harmful agents found in tobacco smoke. Although the user never ignites the invention, the invention is ignited and extinguished during its manufacture so as to closely approximate the look, feel and taste of a traditional cigarette. However, since the user never ignites the invention, it does not pose health or safety hazards and therefore will not be banned in areas where traditional smoking is prohibited. Moreover, the invention is not consumed as it is used and can thus be reused a number of times before replacement is necessary. The invention can be used as a method by which to stop smoking completely, or merely as a substitute to traditional smoking.

BRIEF DESCRIPTION OF THE DRAWINGS

A more complete understanding of the invention may be had by reference to the following Detailed Description when taken in conjunction with the accompanying Drawings in which.

DETAILED DESCRIPTION

Figure 1:
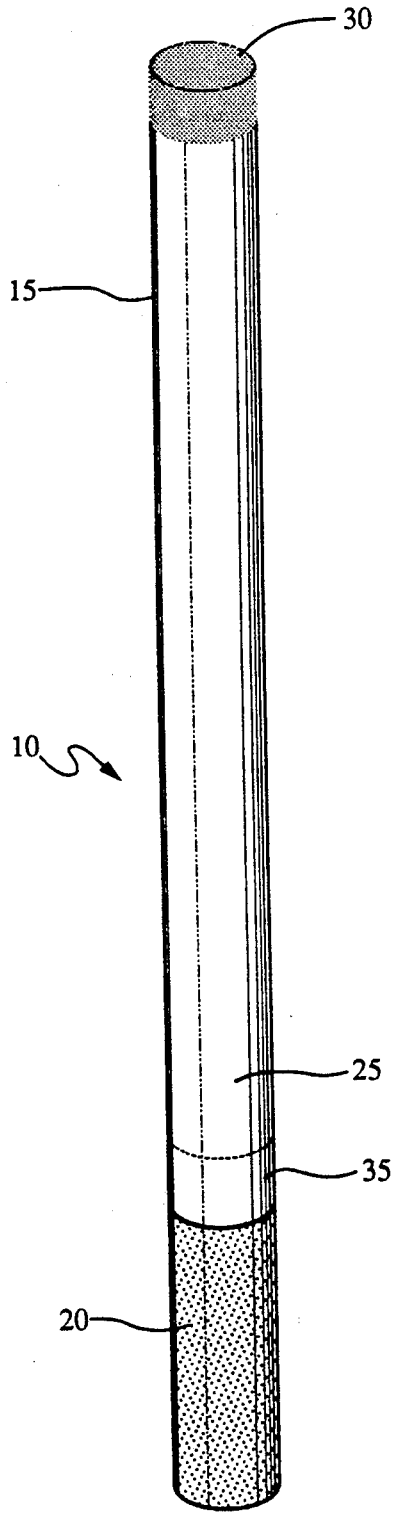
FIG. 1 is a longitudinal view of an embodiment of the invention.

Referring to FIG. 1 of the Drawings, the non-pyrolytic smoking device 10 comprises an elongated outer tube 15 having approximately the same shape, dimensions, weight and feel of a traditional cigarette. This outer tube 15 encloses the internal structures of the smoking device 10, including a mouth filter 20, a longitudinally-extending internal passageway 25, a first chamber 30 containing pre-burned tobacco and a second chamber 35 containing unburned tobacco. Although the outer tube 15 shown is rolled and constructed of conventional cigarette paper, it will be appreciated that other suitable materials and fashioning methods may be used, if desired.

Figure 2:
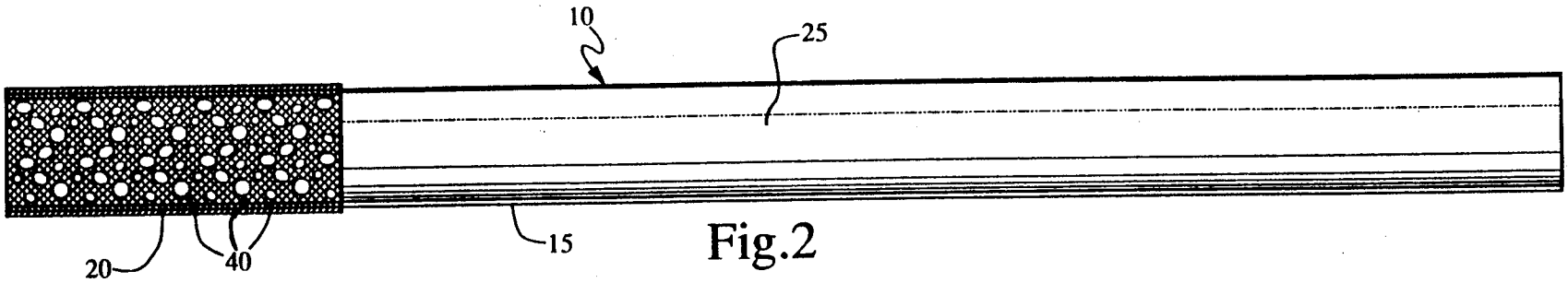
FIG. 2 is a longitudinal sectional view of an embodiment of the invention, illustrating the placement and interior structure of a mouth filter.

As is best illustrated in FIG. 2, towards one end of its length, the smoking device 10 includes a mouth filter 20.

The mouth filter 20 is much like filters used in traditional cigarettes and filters the air stream delivered to the user. Although the mouth filter 20 shown is constructed of conventional materials, it will be appreciated that other materials may be used, or that no filter be used, if desired.

Figure 5:
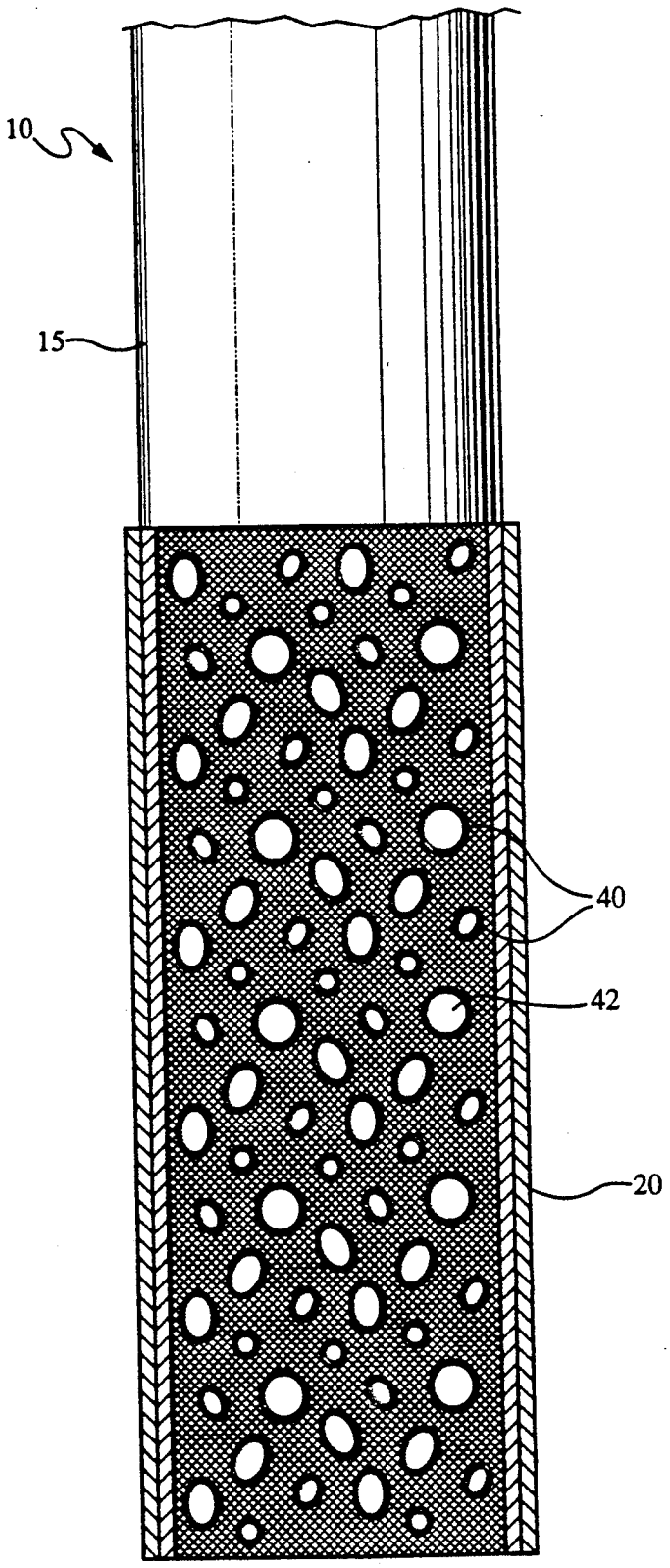
FIG. 5 is an enlarged detailed sectional view demonstrating the placement of nicotine-containing ampules within a mouth filter.

A multiplicity of ampules 40 are disposed within the mouth filter 20. FIG. 5 illustrates in detail the placement of the ampules 40 in the mouth filter 20 of the smoking device 10. Each of the ampules 40 contain nicotine 42. As the user exerts pressure on the exterior of the mouth filter 20, some of the ampules 40 are crushed and release nicotine 42 into the mouth of the user. In this way the user receives nicotine 42 without the associated toxins of tobacco smoke. Although the ampules 40 shown are constructed of gelatine and are dispersed throughout the interior of the mouth filter 20, it will be appreciated that other suitable materials and distribution methods may be used to construct and disperse the ampules 40, and that other methods of containing the nicotine 42 may be used, if desired.

Figure 3:
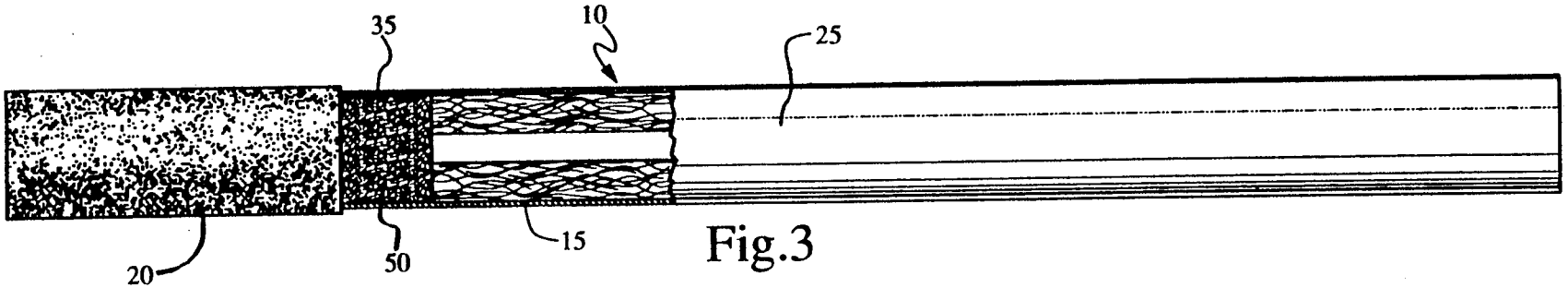
FIG. 3 is a longitudinal sectional view of an embodiment of the invention, illustrating the placement and internal structure of an unburned tobacco chamber.
Figure 4:
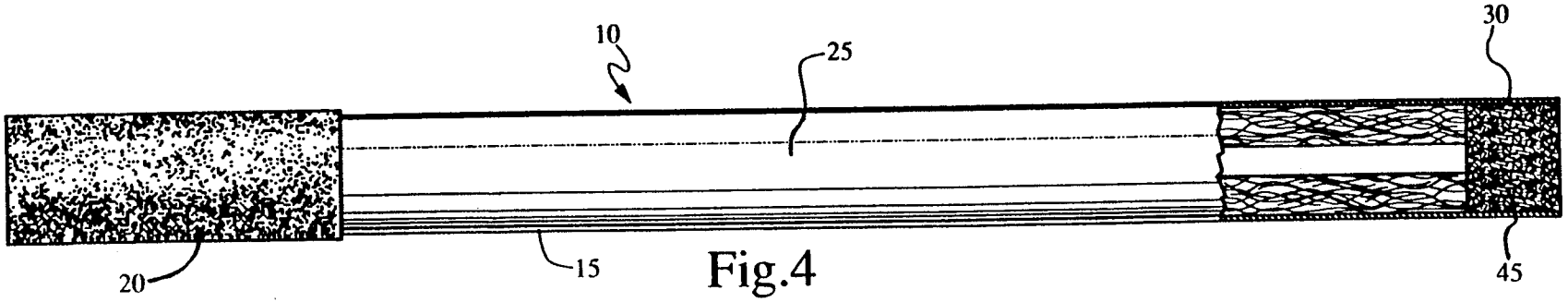
FIG. 4 is a longitudinal sectional view of an embodiment of the invention, illustrating the placement and internal structure of a pre-burned tobacco chamber.

Referring to FIG. 4, the first chamber 30 contains pre-burned tobacco 45 and is located at the opposite end of the smoking device 10 from the mouth filter 20. Referring to FIG. 3, the second chamber 35 contains unburned tobacco 50 and is located at the end of the smoking device 10 closest to the mouth filter 20. As air is drawn by the user through the internal passageway 25 of the smoking device 10, the air communicates with the first and second chambers 30 and 35 and is flavored by the pre-burned and unburned tobacco 45 and 50 before it is delivered to the mouth of the user.

The placement of the pre-burned tobacco 45 at the end of the smoking device 10 opposite the mouth filter 20 and the unburned tobacco 50 at the end of the smoking device 10 closest to the mouth filter 20 allows for maximum flavoring of the air without the introduction of any bitterness into the air stream immediately before it enters the mouth of the user. Although the embodiment shown contains two chambers, one containing unburned tobacco and the other containing pre-burned tobacco, it will be appreciated that any number of chambers could be used, if desired.

Referring again to FIG. 1, the end of the smoking device 10 containing the mouth filter 20 is placed in the mouth of the user. However, the smoking device 10 is not ignited. As the user draws on the smoking device 10, air is drawn into the internal passageway 25 of the smoking device 10. As the air communicates with the first chamber 30, the air is flavored by the pre-burned tobacco 45. As the air continues its travel along the internal passageway 25, it communicates with the second chamber 35, the air being further flavored by the unburned tobacco 50. Additionally, the pressure exerted on the mouth filter 20 by the user, either by biting down on the mouth filter 20 during use or by manually crushing the mouth filter 20 before use, crushes some of the nicotine-containing ampules 40. This releases nicotine 42 into the mouth of the user as the flavored air stream is delivered to the user. The combination of the tobacco-flavored air and the released nicotine 42 provides the user with all of the pleasant aspects associated with traditional cigarette smoking without being exposed to the carcinogens and other harmful agents found in tobacco smoke. Although the internal passageway 25 in this embodiment is shown as a tube of smaller diameter than the outer tube 15, it will be appreciated that other methods of forming an internal passageway could be used, if desired.

Although the user never ignites the smoking device 10, it is ignited and extinguished during its manufacture so that the smoking device 10 will closely approximate the look, feel and taste of a traditional cigarette. However, since the user never ignites the smoking device 10, it avoids the safety hazards which accompany ignited devices and can be reused a number of times before needing replacement.

Only a preferred embodiment of the invention have been shown and described. It should be understood that the invention is not limited to the embodiment disclosed, but is intended to embrace any alternative, modification, rearrangements, or substitutes of parts or elements as fall within the spirit and scope of the invention.

I claim:

1. A smoking device comprising:
an elongated outer tube;
an internal passageway;
at least two chambers disposed within the outer tube;
the chambers communicating with the internal passageway;
a filter located at one end of the outer tube;
one of said chambers containing pre-burned tobacco and located towards the opposite end of the smoking device from the filter; and
means for delivering nicotine to a user.

2. A smoking device of claim 1 wherein the internal passageway is disposed concentrically within, and extends longitudinally along, the length of the outer tube.

3. A smoking device of claim 1 wherein the smoking device is non-pyrolytic during use.

4. A smoking device of claim 1 wherein one of the chambers is located towards the end of the smoking device closest to the filter and contains unburned tobacco.

5. A smoking device of claim 1 wherein the means for delivering nicotine to a user includes a multiplicity of nicotine-containing ampules disposed within the filter.

6. A smoking device of claim 1 wherein the nicotine-containing ampules release nicotine into the interior of the filter in response to crushing the filter.

7. A smoking device of claim 1 wherein the smoking device is reusable.

8. A smoking device comprising:
an elongated outer tube which forms the exterior of the smoking device;
an internal passageway disposed concentrically within, and extending longitudinally along, the length of the outer tube;
a filter located at one end of the outer tube;
said filter containing a multiplicity of ampules;
said ampules containing nicotine;
at least two chambers disposed within the outer tube;
said chambers communicating with the internal passageway; and
one of said chambers containing pre-burned tobacco and located towards the opposite end of the smoking device from the filter.

9. A smoking device of claim 8 wherein the outer tube is wrapped with cigarette paper and is approximately the size and shape of traditional cigarettes.

10. A smoking device of claim 8 wherein the smoking device is non-pyrolytic during use.

11. A smoking device of claim 8 wherein only a portion of the nicotine-containing ampules are crushed during a single use thus making the smoking device reusable.

12. A smoking device comprising:

an elongated outer tube which forms the exterior of the smoking device;

said outer tube being wrapped in cigarette paper;

said outer tube having approximately the size and shape of traditional cigarettes;

an internal passageway disposed concentrically within, and extending longitudinally along, the length of the outer tube;

a filter located at one end of the outer tube;

said filter containing a multiplicity of ampules;

said ampules containing nicotine;

said nicotine being released into said filter in response to crushing said filter;

two chambers disposed within the outer tube;

said chambers communicating with the internal passageway;

the first said chamber being located towards the opposite end of the smoking device from the filter and containing burned tobacco for flavoring air within the internal passageway; and the second said chamber being located towards the end of the smoking device closest to the filter and containing unburned tobacco for flavoring air within the internal passageway.

13. A smoking device of claim 12 wherein the smoking device is non-pyrolytic during use.

14. A smoking device of claim 12 wherein only a portion of the nicotine-containing ampules are crushed during a single use thus making the smoking device reusable.

15. A smoking device comprising:

an elongated outer tube which forms the exterior of the smoking device;

an internal passageway disposed concentrically within, and extending longitudinally along, the length of the outer tube;

a filter located at one end of the outer tube;

said filter containing a multiplicity of ampules;

said ampules containing nicotine;

at least two chambers disposed within the outer tube;

said chambers communicating with the internal passageway;

one of said chambers containing pre-burned tobacco and located towards the opposite end of the smoking device from the filter; and one of said chambers is located towards the end of the smoking device closest to the filter and contains unburned tobacco for the flavoring of air as it is drawn through the internal passageway.

* * * * *